US011326753B2

(12) United States Patent
Jun

(10) Patent No.: US 11,326,753 B2
(45) Date of Patent: May 10, 2022

(54) LAMP FOR AUTOMOBILE AND AUTOMOBILE INCLUDING THE SAME

(71) Applicant: HYUNDAI MOBIS Co., Ltd., Seoul (KR)

(72) Inventor: Young Geun Jun, Yongin-si (KR)

(73) Assignee: Hyundai Mobis Co., Ltd., Seoul (KR)

( * ) Notice: Subject to any disclaimer, the term of this patent is extended or adjusted under 35 U.S.C. 154(b) by 0 days.

(21) Appl. No.: 17/137,153

(22) Filed: Dec. 29, 2020

(65) Prior Publication Data

US 2021/0239288 A1 Aug. 5, 2021

(30) Foreign Application Priority Data

Jan. 31, 2020 (KR) ..... 10-2020-0011589

(51) Int. Cl.
*F21S 41/151* (2018.01)
*F21S 41/143* (2018.01)
*F21S 41/20* (2018.01)

(52) U.S. Cl.
CPC ..... *F21S 41/151* (2018.01); *F21S 41/143* (2018.01); *F21S 41/285* (2018.01)

(58) Field of Classification Search
None
See application file for complete search history.

(56) References Cited

U.S. PATENT DOCUMENTS

| | | | | |
|---|---|---|---|---|
| 7,500,773 | B2 | 3/2009 | Komatsu | |
| 7,982,403 | B2 | 7/2011 | Hohl-Abichedid et al. | |
| 10,018,317 | B2 * | 7/2018 | Taudt | F21S 41/24 |
| 10,465,875 | B2 | 11/2019 | Nakazato | |

(Continued)

FOREIGN PATENT DOCUMENTS

| | | |
|---|---|---|
| DE | 102007008994 | 9/2007 |
| EP | 2280215 | 2/2011 |
| EP | 2586659 | 5/2013 |

(Continued)

OTHER PUBLICATIONS

Office Action dated Apr. 29, 2021, issued in Korean Patent Application No. 10-2020-0011589—with unverified machine translation.

(Continued)

*Primary Examiner* — Britt D Hanley
(74) *Attorney, Agent, or Firm* — H.C. Park & Associates, PLC

(57) ABSTRACT

A lamp for an automobile and an automobile including the same include first and second modules that generate light to emit the light to the outside and are spaced apart from each other, respectively including a first light source unit and a second light source unit that include a plurality of light sources which generate light and are provided in a horizontal direction. The light generated from the plurality of light sources provided in each of the first light source unit and the second light source unit is emitted to the outside to produce a plurality of beam patterns, and thus a first beam pattern group and a second beam pattern group are produced. A portion of the plurality of beam patterns constituting the second beam pattern group are produced in at least a portion of a region between the plurality of beam patterns constituting the first beam pattern group.

12 Claims, 7 Drawing Sheets

(56) References Cited

U.S. PATENT DOCUMENTS 10,731,824 B2 8/2020 Kawai et al.

FOREIGN PATENT DOCUMENTS

| | | |
|---|---|---|
| EP | 3489083 | 5/2019 |
| EP | 3508777 | 7/2019 |
| EP | 3540296 | 9/2019 |
| FR | 2991251 | 12/2013 |
| JP | 2019-197743 | 11/2019 |
| KR | 10-2010-0122640 | 11/2010 |
| KR | 10-1270066 | 5/2013 |
| KR | 10-2017-0024832 | 3/2017 |
| KR | 10-2017-0027388 | 3/2017 |
| KR | 10-2017-0076144 | 7/2017 |
| KR | 10-2017-0076183 | 7/2017 |
| KR | 10-2017-0112268 | 10/2017 |
| KR | 10-2019-0032069 | 3/2019 |
| KR | 10-2019-0067437 | 6/2019 |
| WO | 2017015684 | 2/2017 |

OTHER PUBLICATIONS

Extended European Search Report dated Jun. 7, 2021, issued in European Patent Application No. 20214689.0.

* cited by examiner

LAMP FOR AUTOMOBILE AND AUTOMOBILE INCLUDING THE SAME

CROSS-REFERENCE TO RELATED APPLICATION

This application claims priority from and the benefit of Korean Patent Application No. 10-2020-0011589, filed on Jan. 31, 2020, which is hereby incorporated by reference for all purposes as if set forth herein.

BACKGROUND

Field

Exemplary embodiments relate to a lamp for an automobile and an automobile including the same.

Discussion of the Background

Lamps for automobiles may be mainly divided into head lamps installed in the front of the automobile and tail lamps installed in the rear of the automobile. Among these lamps, the head lamps are mounted on left and right sides of the front portion of the automobile to illuminate a front side of the automobile in situations such as night driving and the like, thereby securing a driver's forward field.

Such a head lamp may be classified again into a high beam used when driven on a road without an opposing automobile and a low beam used in general road situations except for the situations using the high beam.

Recently, head lamp technologies that are in conjunction with sensor technologies to generate a dark region in which an opposing automobile exists when there is an automobile approaching through the opposite side are being developed.

The above information disclosed in this Background section is only for enhancement of understanding of the background of the invention and, therefore, it may contain information that does not constitute prior art.

SUMMARY

Exemplary embodiments of the present invention is to manufacture a head lamp having excellent resolution, luminous intensities, uniformity of brightness of light, or the like while using a smaller number of the light sources than in the related art.

Additional features of the invention will be set forth in the description which follows, and in part will be apparent from the description, or may be learned by practice of the invention.

A first exemplary embodiment of the present invention provides a lamp for an automobile, the lamp including first and second modules configured to generate light and emit the light to the outside, first and second modules being spaced apart from each other. The first module includes a first light source unit including a plurality of light sources configured to generate light and provided in a horizontal direction, and the second module includes a second light source unit including a plurality of light sources configured to generate light and provided in the horizontal direction. The light generated from the plurality of light sources provided in each of the first light source unit and the second light source unit is emitted to the outside to produce a plurality of beam patterns. The plurality of beam patterns produced by all of the plurality of light sources provided in the first light source unit are arranged in the horizontal direction to produce a first beam pattern group, and the plurality of beam patterns produced by all of the plurality of light sources provided in the second light source unit are arranged in the horizontal direction to produce a second beam pattern group. At least a portion of the plurality of beam patterns constituting the second beam pattern group is produced in at least a portion of a region between the plurality of beam patterns constituting the first beam pattern group.

The first beam pattern group may have a plurality of first peaks which are respectively produced by the plurality of light sources constituting the first light source unit and each of which has a maximum value in luminance of the light in the horizontal direction, and the second beam pattern group may have a plurality of second peaks which are respectively produced by the plurality of light sources constituting the second light source unit and each of which has a maximum value in luminance of the light in the horizontal direction. At least a portion of the plurality of the second peaks is provided in at least a portion of a region between the plurality of first peaks.

The first module may further include a first rod unit configured to provide a path through which the light generated by the first light source unit moves; and a first lens through which the light emitted from the first rod unit passes to be emitted to the outside. The second module may further include a second rod unit configured to provide a path through which the light generated by the second light source unit moves; and a second lens through which the light emitted from the second rod unit passes to be emitted to the outside.

A horizontal width of a beam pattern which is produced at one end portion in the horizontal direction among the plurality of beam patterns constituting the first beam pattern group may be less than a horizontal width of a beam pattern which is produced at the other end portion in the horizontal direction among the plurality of beam patterns constituting the first beam pattern group.

Horizontal widths of the plurality of beam patterns constituting the first beam pattern group may increase gradually from one end portion of the first beam pattern group in the horizontal direction toward the other end portion of the first beam pattern group in the horizontal direction.

A horizontal width of a beam pattern which is produced at one end portion in the horizontal direction among the plurality of beam patterns constituting the second beam pattern group may be less than a horizontal width of a beam pattern which is produced at the other end portion in the horizontal direction among the plurality of beam patterns constituting the second beam pattern group.

Horizontal widths of the plurality of beam patterns constituting the second beam pattern group may increase gradually from one end portion of the second beam pattern group in the horizontal direction toward the other end portion of the second beam pattern group in the horizontal direction.

At least a portion of the first beam pattern group may overlap at least a portion of the second beam pattern group.

Turning on/off of the plurality of light sources constituting the first light source unit and the second light source unit may be controlled independently with respect to each other, and when the plurality of light sources that emit light to a portion of an irradiation region produced by the first beam pattern group and the second beam pattern group are turned off, a dark region to which the light does not reach may be produced in a portion of the irradiation region.

Luminance of the light, which is emitted from the plurality of light sources constituting the first light source unit and the second light source unit, may be controlled independently with respect to each other.

Luminance of light emitted from remaining light sources other than light sources that emit the light to regions closest to the dark region among the plurality of light sources constituting the first light source unit and the second light source unit may be greater than luminance of light emitted from the remaining light sources when the dark region is not produced.

A second exemplary embodiment of the present invention provides an automobile including the lamp.

The lamp may be provided on a left side or a right side of a front portion of the automobile.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
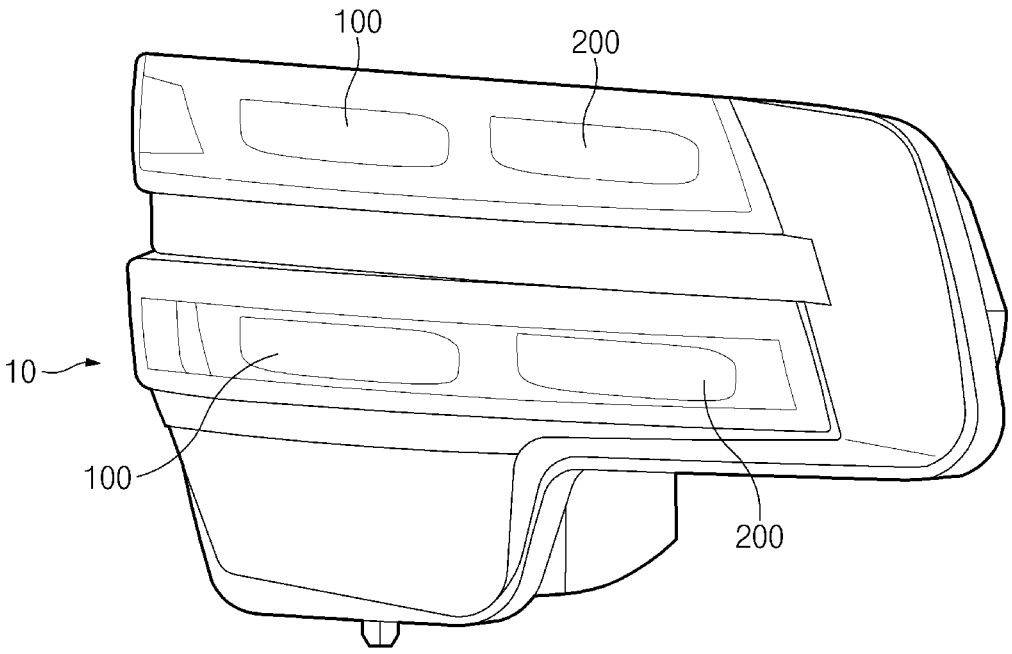
FIG. 1 is a perspective view illustrating a lamp for an automobile according to the present invention.

The invention is described more fully hereinafter with reference to the accompanying drawings, in which embodiments of the invention are illustrated. This invention may, however, be embodied in many different forms and should not be construed as limited to the embodiments set forth herein. Rather, these embodiments are provided so that this disclosure is thorough, and will fully convey the scope of the invention to those skilled in the art. Like reference numerals in the drawings denote like elements.

Hereinafter, a lamp for an automobile according to the present invention and an automobile including the lamp for an automobile will be described with reference to the accompanying drawings.

According to embodiments, a plurality of light sources (for examples, LEDs) are installed in the head lamp to selectively generate a dark region in a partial region in a manner in which the light source that emits light into the region that intends to generate the dark region.

However, according to the related art, it is necessary to install a large number of light sources in the head lamp so as to manufacture the head lamp having excellent resolution, luminous intensities, uniformity of brightness of light, and the like while selectively generating the dark region. However, this causes an excessive increase in cost and time, which are required for manufacturing the head lamp.

Lamp for Automobile

Figure 2:
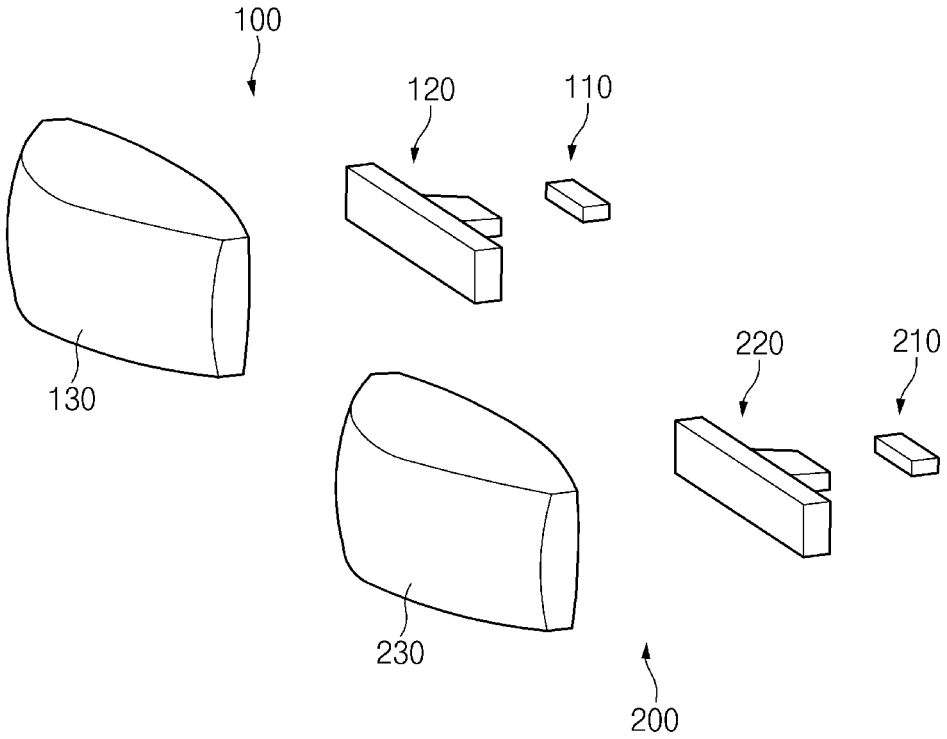
FIG. 2 is a perspective view illustrating configurations of a first module and a second module in the lamp for an automobile according to the present invention.
Figure 3:
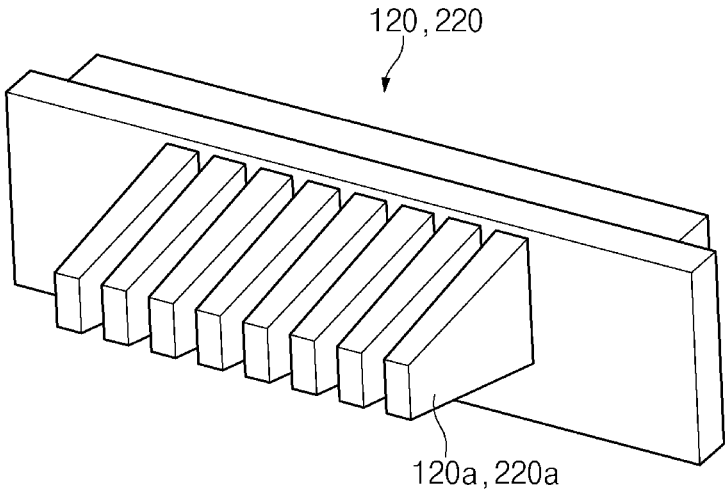
FIG. 3 is an enlarged perspective view illustrating a rod unit according to the present invention.
Figure 4:
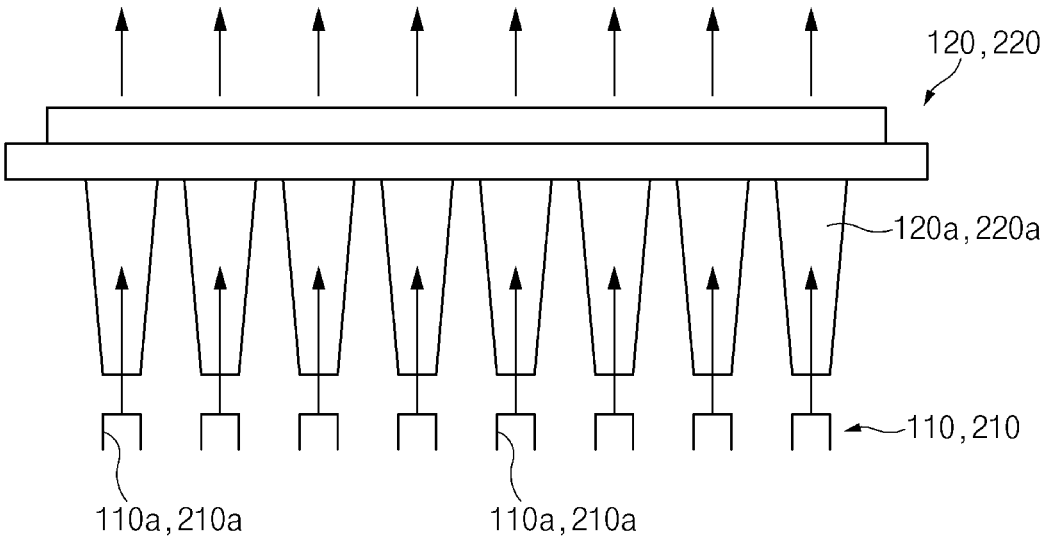
FIG. 4 is a horizontal cross-sectional view illustrating a state in which light of a light source unit moves through the rod unit in the lamp for an automobile according to the present invention.

FIG. 1 is a perspective view illustrating a lamp for an automobile according to the present invention, and FIG. 2 is a perspective view illustrating configurations of a first module and a second module in the lamp for an automobile according to the present invention. FIG. 3 is an enlarged perspective view illustrating a rod unit according to the present invention, and FIG. 4 is a horizontal cross-sectional view illustrating a state in which light of a light source unit moves through the rod unit in the lamp for an automobile according to the present invention.

A lamp 10 for an automobile according to the present invention (hereinafter, referred to as a 'lamp') is mounted on an automobile and may be configured to emit light to the outside of the lamp to assist in securing a driver's view.

As illustrated in FIGS. 1 and 2, the lamp 10 may include a first module 100 and a second module 200 which generate light and emit the light to the outside. As illustrated in FIGS. 1 and 2, the first module 100 and the second module 200 may be spaced apart from each other in a horizontal direction and may include multiple sets within the lamp 10.

As illustrated in FIG. 2, the first module 100 may include a first light source unit 110 configured to generate light, a first rod unit 120 configured to provide a path through which the light generated by the first light source unit 110 is transmitted, and a first lens 130 through which the light emitted from the first rod unit 120 passes to be emitted to the outside of the lamp 10. Also, the second module 200 may include a second light source unit 210 configured to generate light, a second rod unit 220 configured to provide a path through which the light generated by the second light source unit 210 moves, and a second lens 230 through which the light emitted from the second rod unit 220 passes to be emitted to the outside of the lamp 10. Each of the first lens 130 and the second lens 230 may be an aspherical lens in which a refraction surface is not a spherical surface but a curved surface. However, the types of the first lens and the second lens are limited thereto.

Also, as illustrated in FIG. 3, the first rod unit 120 and the second rod unit 220 may include a plurality of rods 120*a* and 220*a* having cavities therein, respectively. The light generated by the first light source unit 110 (see FIG. 2) may move through paths which are defined by the cavities within the plurality of rods 120*a* provided in the first rod unit 120, and the light generated by the second light source unit 210 (see FIG. 2) may move through paths which is are defined by the cavities within the plurality of rods 220*a* provided in the second rod unit 220. FIG. 3 illustrates a configuration in which eight rods are provided in each of the first rod unit 120 and the second rod unit 220. However, the number of the rods provided in the first rod unit 120 and the second rod unit 220 is not limited to the drawing.

As illustrated in FIG. 4, the first light source unit 110 of the first module 100 may include a plurality of light sources 110*a*, and the second light source unit 210 of the second module 200 may also include a plurality of light sources 210*a*. For example, the plurality of light sources 110*a* of the first light source unit 110 and the plurality of light sources

210*a* of the second light source unit 210 may be light emitting diodes (LED). Also, the number of the light sources 110*a* provided in the first light source unit 110 may be equal to the number of the rods 120*a* provided in the first rod unit 120. More preferably, the plurality of the light sources 110*a* provided in the first light source unit 110 may face the plurality of the rods 120*a* provided in the first rod unit 120 in one-to-one correspondence. Similarly, the number of the light sources 210*a* provided in the second light source unit 210 may be equal to the number of the rods 220*a* provided in the second rod unit 220. More preferably, the plurality of the light sources 210*a* provided in the second light source unit 210 may face the plurality of the rods 220*a* provided in the second rod unit 220 in one-to-one correspondence. FIG. 4 illustrates a configuration in which eight light sources are provided in each of the first light source unit 110 and the second light source unit 210. However, the number of the light sources provided in the first light source unit 110 and the second light source unit 210 is not limited to the drawing.

The above descriptions are summarized as follows. The light generated by the plurality of light sources 110*a* provided in the first light source unit 110 is supplied to the first rod unit 120. The light supplied to the first rod unit 120 moves through the cavities within the plurality of rods 120*a* provided in the first rod unit 120. The light passing through the plurality of rods 120*a* is emitted from the first rod unit 120 and then supplied to the first lens 130. The light passing through the first lens 130 is emitted to the outside, and a beam pattern is produced outside by the light. Similarly, the light generated by the plurality of light sources 210*a* provided in the second light source unit 210 is supplied to the second rod unit 220. The light supplied to the second rod unit 220 moves through the cavities within the plurality of rods 220*a* provided in the second rod unit 220. The light passing through the plurality of rods 220*a* is emitted from the second rod unit 220 and then supplied to the second lens 230. The light passing through the second lens 230 is emitted to the outside, and a beam pattern is produced outside by the light.

Figure 5:
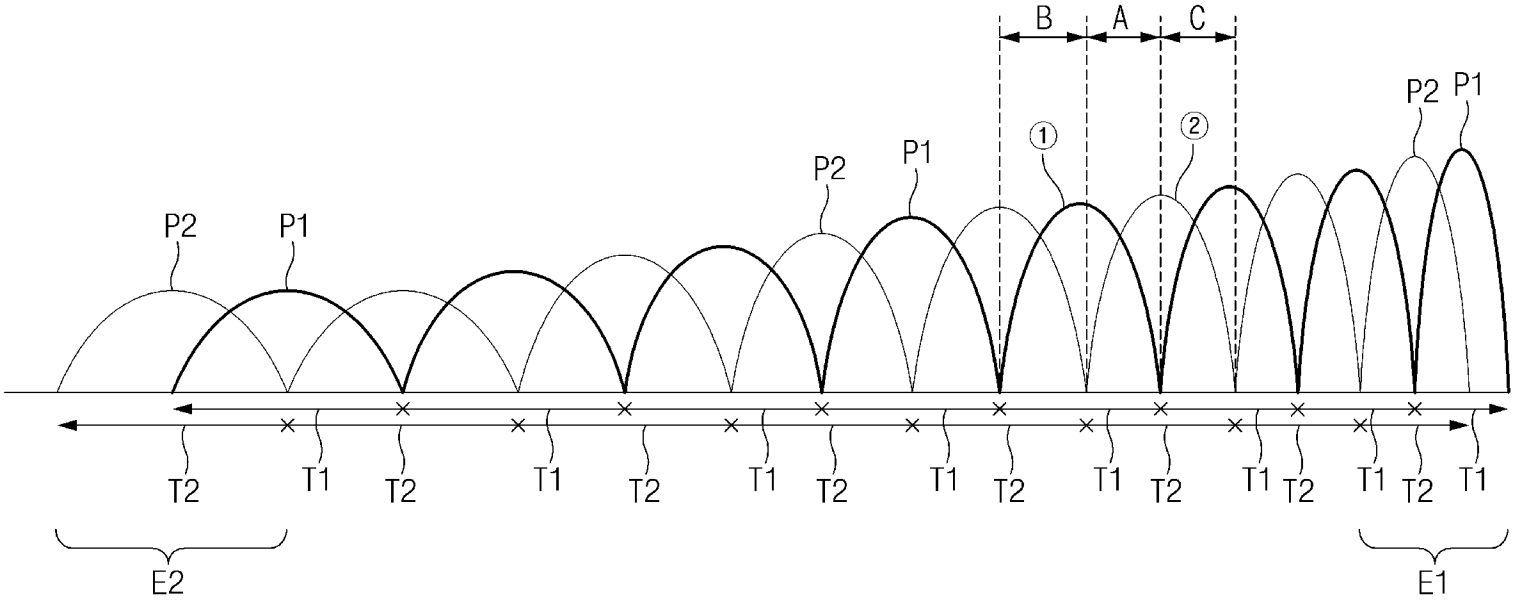
FIG. 5 is a view illustrating configurations of a first beam pattern group and a second beam pattern group which are produced by the first module and the second module in the lamp for an automobile according to the present invention.

FIG. 5 is a view illustrating configurations of a first beam pattern group and a second beam pattern group which are produced by the first module 100 and the second module 200 in the lamp 10 for an automobile according to the present invention.

In FIG. 5, a horizontal axis represents a horizontal direction of a region to which the light emitted from the first module 100 and the second module 200 reaches. Stretched across the horizontal axis are a plurality of parabolas of wide to narrow width. Regions provided below the plurality of parabolas of the horizontal axis represent beam patterns respectively produced by the plurality of light sources 110*a*/210*a* provided by the first light source unit 110 and the second light source unit 120 respectively. More specifically, a region provided below a parabola P1 drawn by a relatively thick solid line in the horizontal axis represents a beam pattern produced by each of the plurality of light sources 110*a* provided in the first light source unit 110, and a region provided below a parabola P2 drawn by a relatively thin solid line represents a beam pattern produced by each of the plurality of light sources 210*a* provided in the second light source unit 210.

Also, a first beam pattern group T1 may be produced by gathering the beam patterns which are respectively produced by the light sources 110*a* provided in the first light source unit 110, and a second beam pattern group T2 may be produced by gathering the beam patterns which are respectively produced by the light sources 210*a* provided in the second light source unit 210. Here, each of the plurality of parabolas P1 and P2 illustrated in FIG. 5 is a graph illustrating luminance of the beam pattern which is produced by each of the plurality of light sources 110*a* and 210*a* constituting the first light source unit 110 and the second light source unit 210, respectively. For example, as illustrated in FIG. 5, the luminance in a central region, in the horizontal direction, of the individual beam pattern produced by each of the plurality light sources 110*a* and 210*a* constituting the first light source unit 110 and the second light source unit 210 may be higher than the luminance in both end regions of the individual beam pattern in the horizontal direction. As one example of the present invention, FIG. 5 illustrates the first beam pattern group T1 having eight beam patterns produced by the plurality of light sources 110*a* provided in the first light source unit 110 and the second beam pattern group T2 having eight beam patterns produced by the plurality of light sources 210*a* provided in the second light source unit 210. This may be understood because eight light sources 110*a* and 120*a* respectively are provided in each of the first light source unit 110 and the second light source unit 120.

As described above, according to the present invention, the light generated by the plurality of light sources provided in the first light source unit 110 and the second light source unit 120 may be emitted to the outside of the lamp 10 to produce the plurality of beam patterns T1 and T2 and varied luminances.

Here, the plurality of beam patterns produced by all of the plurality of light sources 110*a* provided in the first light source unit 110 may be arranged in the horizontal direction. Thus, the first beam pattern group T1 may be produced in the horizontal direction.

Also, the plurality of beam patterns produced by all of the plurality of light sources 210*a* provided in the second light source unit 210 may be arranged in the horizontal direction. Thus, the second beam pattern group T2 may also be produced in the horizontal direction.

Here, according to the present invention, at least a portion of the plurality of beam patterns constituting the second beam pattern group T2 is produced in at least a portion of a region between the plurality of beam patterns constituting the first beam pattern group T1, as illustrated in FIG. 5.

Here, at least a portion of the plurality of beam patterns constituting the second beam pattern group T2 is produced in at least a portion of a region between the plurality of beam patterns constituting the first beam pattern group T1. This may mean that the plurality of beam patterns constituting the first beam pattern group T1 are spaced apart from each other at predetermined intervals to produce a portion of the plurality of beam patterns constituting the second beam pattern group T2 in regions defined by the predetermined intervals between the plurality of beam patterns constituting the first beam pattern group T1. Thus, as illustrated in FIG. 5, even in a case in which the plurality of beam patterns constituting the first beam pattern group T1 are not spaced apart from each other, it may be understood that, when at least a portion of the first beam pattern group T1 and at least a portion of the second beam pattern group T2 overlap each other, at least a portion of the plurality of beam patterns constituting the second beam pattern group T2 is produced in at least a portion of a region between the plurality of beam patterns constituting the first beam pattern group T1. In other words, peaks of each of the plurality of beam patterns constituting the second beam pattern group T2 may be produced in a region between the peaks of a plurality of beam patterns constituting the first beam pattern group T1.

Referring to FIG. 5 again, the first beam pattern group T1 may have a plurality of first peaks P1 which are respectively produced by the plurality of light sources 110*a* constituting the first light source unit 110 and have respectively maximum values in luminance in the vertical direction, and the second beam pattern group T2 may have a plurality of second peaks P2 which are respectively produced by the plurality of light sources 210*a* constituting the second light source unit 210 and have respectively maximum values in luminance in the vertical direction. A width of the parabolas represents the beam width of each light source 110*a* or 210*a*. As one example of the present invention, FIG. 5 illustrates a case in which there are eight first peaks and eight second peaks.

Here, according to the present invention, at least a portion of the plurality of second peaks P2 may be provided in at least a portion of a region between the plurality of first peaks P1 in the horizontal. More preferably, each of the plurality of second peaks P2 may be provided between the plurality of first peaks P1.

Generally, among indexes indicating performance of a lamp 10 for an automobile, resolution and uniformity of brightness for each region have a trade-off relationship. That is, a light source 110*a* or 210*a* producing a beam pattern with a narrow width may be installed to improve the resolution of the lamp for an automobile. However, in this case, the uniformity of brightness of light in the lamp 10 for an automobile is degraded due to beam patterns having a narrow width (that is, the brightness changes discontinuously for each region). On the other hand, a light source producing a beam pattern with a wide width may be installed to improve the uniformity of the lamp of an automobile. However, in this case, due to the beam pattern with the wide width, the division between the light of the neighboring light sources (for example, LEDs) is unclear, and thus the resolution of the lamp for an automobile is degraded. Thus, as described herein, a minimum width of a dark region produced by using the lamp for an automobile may increase in this case.

To improve both the resolution and the uniformity of brightness of light of the lamp for an automobile, a method may be considered, in which (i) a plurality of light sources having the beam patterns with the narrow widths are installed (ii) at close intervals. However, this causes an excessive increase in cost and time used to manufacture the lamp for an automobile.

According to the present invention, the lamp 10 for an automobile, which is improved in the resolution as well as the uniformity of brightness of light, may be manufactured by using the light sources 110*a* and 210*a* producing beam patterns with wide and varying widths.

For example, in a case in which beam patterns produced by first light sources 110*a* that provide beam patterns with wide widths and beam patterns produced by second light sources 210*a* that provide beam patterns with narrow widths overlap each other, beam pattern groups produced by the first light sources 110*a* and the second light sources 210*a* may be divided into (i) regions produced by only the light emitted from the first light sources 110*a*, (ii) regions produced by only the light emitted from the second light sources 210*a*, and (iii) regions in which the light emitted from the first light sources 110*a* and the light emitted from the second light sources 210*a* overlap each other. As illustrated in FIG. 1 the first module 100 is positioned next to the second module 200, when shone outward, light from the light source units 110 and 120 overlaps as illustrated in FIG. 5.

In this case, a minimum width, enabling the determination of whether or not dark regions are produced, decreases by the (iii) regions, and thus the resolution of the lamp 10 for an automobile may be further improved by using the light sources even having the same performance, when compared to a case in which the beam patterns produced by the first light sources 110*a* and the beam patterns produced by the second light sources 210*a* do not overlap each other. Also, because the beam patterns produced by the first light sources 110*a* and the beam patterns produced by the second light sources 210*a* overlap each other, the brightness of light changes continuously, and thus the uniformity of brightness of light may also be improved.

Furthermore, according to the above example, because three different beam pattern regions which are individually controlled may be produced by two light sources, beam patterns produced in the large number of regions may be individually controlled by the small number of light sources. For example, three light sources are have been used to individually control beam patterns produced in three regions according to the related art. However, only two light sources are used according to the present invention. The effects of the present invention described above may be maximized when the beam patterns produced by the light sources overlap each other more and more.

Also, an automobile that approaches from the opposite side during a driving situation of an automobile usually approaches central region of a driver's view. Thus, the luminance of a beam pattern produced by the lamp for an automobile in the central region in front of the automobile may be high.

Referring to FIG. 5, to this end, a horizontal width of a beam pattern which is produced at one end portion E1 in the horizontal direction among the plurality of beam patterns constituting the first beam pattern group T1 may be less than a horizontal width of a beam pattern which is produced at the other end portion E2 in the horizontal direction among the plurality of beam patterns constituting the first beam pattern group T1. More preferably, horizontal widths of the plurality of beam patterns constituting the first beam pattern group T1 may increase gradually from one end portion E1 of the first beam pattern group T1 in the horizontal direction toward the other end portion E2 of the first beam pattern group T1 in the horizontal direction. In this case, the horizontal width of the individual beam pattern producing the first beam pattern group T1 decreases toward the one end portion in the horizontal direction. Thus, because the beam pattern is produced over a relatively narrow width, the luminance of the beam pattern may also increase.

A horizontal width of a beam pattern which is produced at one end portion E1 in the horizontal direction among the plurality of beam patterns constituting the second beam pattern group T2 may be less than a horizontal width of a beam pattern which is produced at the other end portion E2 in the horizontal direction among the plurality of beam patterns constituting the second beam pattern group T2. More preferably, horizontal widths of the plurality of beam patterns constituting the second beam pattern group T2 increase gradually from one end portion E1 of the second beam pattern group T2 in the horizontal direction toward the other end portion E2 of the second beam pattern group T2 in the horizontal direction. In this case, the horizontal width of the individual beam pattern producing the second beam pattern group T2 also decreases toward the one end portion in the horizontal direction. Thus, because the beam pattern is produced over a relatively narrow width, the luminance of the beam pattern may also increase.

In this case, the one end portion E1 of the plurality of beam patterns in the horizontal direction may be adjacent to a central region of the lamp 10 in front of the automobile towards a center of an automobile, and the other end portion E2 of the plurality of beam patterns in the horizontal direction may be adjacent to an outer region of the lamp 10 in front of the automobile towards an edge of the automobile. Thus, the luminance of the beam pattern produced by the lamp for an automobile may be high in the central region in front of the automobile.

Figure 6:
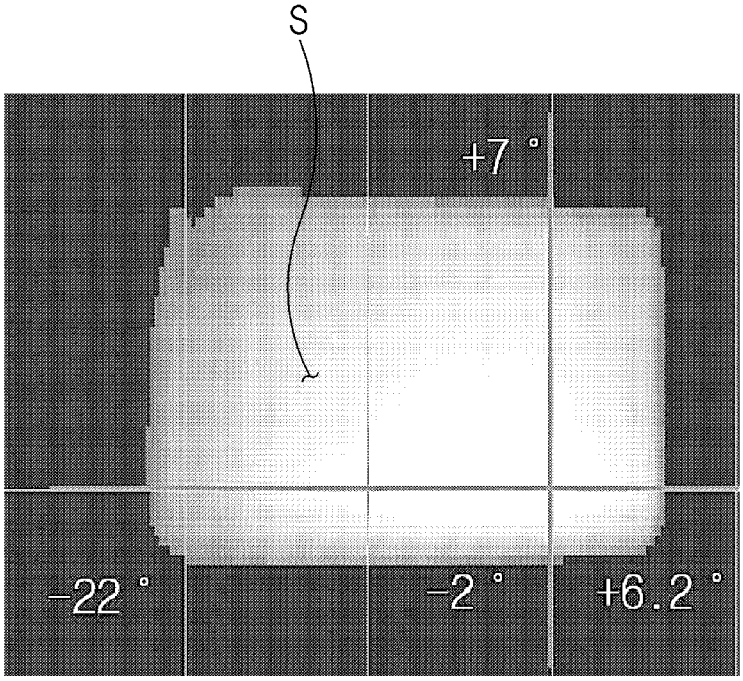
FIG. 6 is a photograph illustrating an irradiation region produced by the lamp for an automobile according to the present invention.
Figure 7:
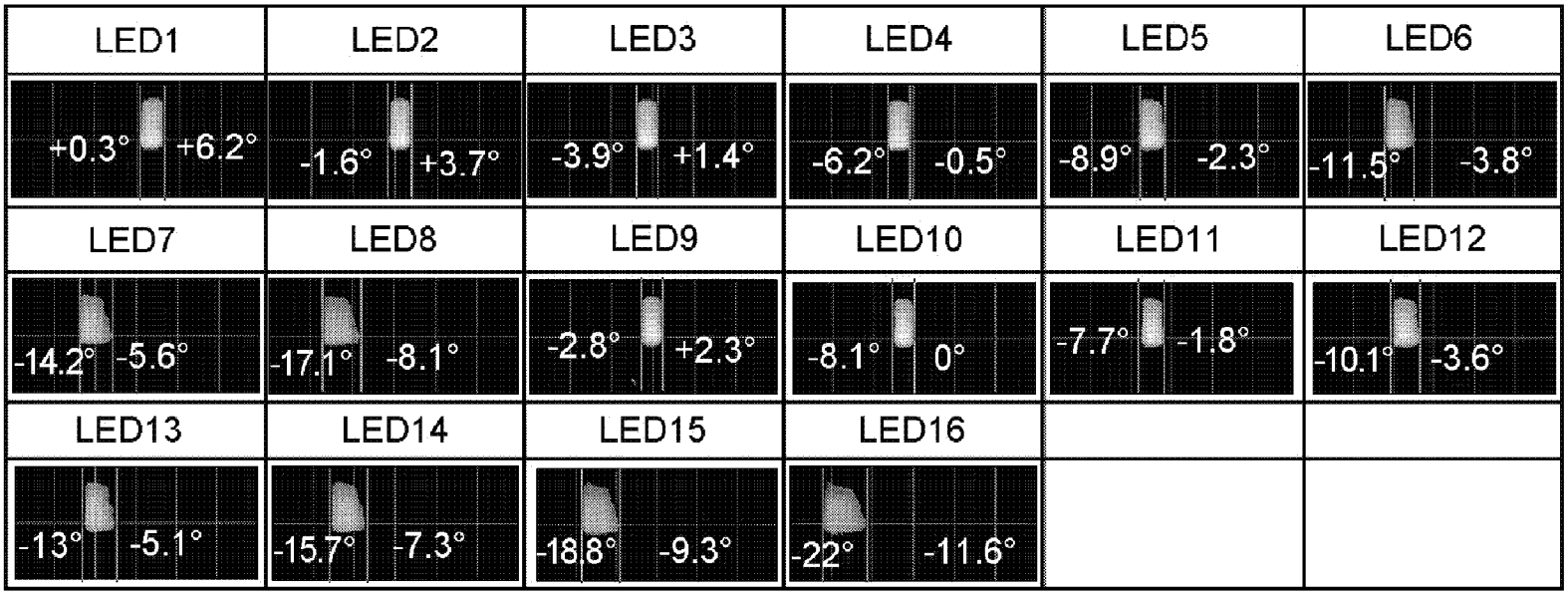
FIG. 7 is a photograph illustrating an individual beam pattern produced by each of light sources of the lamp for an automobile according to the present invention.

FIG. 6 is a photograph illustrating an irradiation region produced by the lamp for an automobile according to the present invention, and FIG. 7 is a photograph illustrating an individual beam pattern produced by each of light sources of the lamp for an automobile according to the present invention.

When all of the plurality of light sources constituting the first light source unit 110 and the second light source unit 210 according to the present invention are turned on, a predetermined irradiation region S may be defined by both the first beam pattern group produced by the first light source unit 110 and the second beam pattern group produced by the second light source unit 210 as illustrated in FIG. 6. Here, in FIG. 7, the photographs denoted as LED 1 to LED 8 may represent the individual beam patterns respectively produced by the plurality of light sources 110*a* constituting the first light source unit 110 of the first module 100, and the photographs denoted as LED 9 to LED 16 may represent the individual beam patterns respectively produced by the plurality of light sources 210*a* constituting the second light source unit 210 of the second module 200.

When examining FIG. 7, it may be confirmed that the width of the beam pattern illustrated in the photographs increases gradually from LED 1 to LED 8, but the luminance (that is, brightness) of the beam pattern decreases. Thus, the beam pattern illustrated in the picture denoted as LED 1 may be the beam pattern produced at the one end portion E1 in the horizontal direction when referring to FIG. 5, and the beam pattern illustrated in the picture denoted as LED 8 may be the beam pattern produced at the other end portion E2 in the horizontal direction when referring to FIG. 5.

When examining FIG. 7 again, it may be confirmed that the width of the beam pattern illustrated in the photographs increases gradually from the LED 9 to LED 16, but the luminance (that is, brightness) of the beam pattern decreases. Thus, the beam pattern illustrated in the picture denoted as LED 9 may be the beam pattern produced at the one end portion E1 in the horizontal direction when referring to FIG. 5, and the beam pattern illustrated in the picture denoted as LED 16 may be the beam pattern produced at the other end portion E2 in the horizontal direction when referring to FIG. 5.

Here, referring to FIGS. 1 to 5, turning on/off of the plurality of light sources 110*a* and 120*a* constituting the first light source unit 110 and the second light source unit 210 respectively in the lamp 10 according to the present invention may be controlled independently with respect to each other. Thus, according to the present invention, as all of the plurality of light sources that emit light to a portion of irradiation region S (see FIG. 6) produced by the first beam pattern group T1 and the second beam pattern group T2 are turned off, a dark region to which the light emitted from the lamp does not reach is produced in a portion of the irradiation region.

More preferably, the luminance of light emitted from the plurality of light sources constituting the first light source unit 110 and the second light source unit 210 may be controlled independently with respect to each other. Also, according to the present invention, luminance of light emitted from remaining light sources other than light sources that emit the light to regions closest to the dark region among the plurality of light sources constituting the first light source unit 110 and the second light source unit 210 may be greater than luminance of light emitted from the remaining light sources when the dark region is not produced.

Referring to FIG. 5, for example, in a case in which dark region is to be produced in a region A of the irradiation region produced by the first beam pattern group T1 and the second beam pattern group T2, light sources producing beam patterns corresponding to a region ① and a region ② of FIG. 5 have to be turned off. However, in this case, because the light sources producing the beam patterns corresponding to the region ① and the region ② emit light to each of a region B and a region C adjacent to the region A in addition to the region A, brightness of light in the region B and the region C adjacent to the region A is reduced when the dark region is produced in the region A. Thus, when the dark region is produced in the region A, the light sources emitting the light to the region A are turned off, and thus the brightness of the light emitted to the region B and the region C adjacent to the region A from other light sources may be increased. Therefore, the luminance of a portion of the plurality of light sources may increase.

However, in a case of increasing the luminance of the light sources (that is, the light sources closest to the light sources producing the beam patterns corresponding to region ① and region ②) emitting the light to the regions closest to the region A in which the dark region is to be produced, a glare phenomenon, that is, a dazzling phenomenon occurs in a boundary of the dark region. Thus, in a case to produce the dark region in the region A, it is preferable not to turn off the light sources emitting light to the region A, and increase the luminance of the light sources emitting the light to the regions closest to the region A among the plurality of light sources.

Thus, according to the present invention, the luminance of light emitted from remaining light sources other than light sources that emit the light to regions closest to the dark region among the plurality of light sources constituting the first light source unit 110 and the second light source unit 210 is controlled to be greater than the luminance of light emitted from the remaining light sources when the dark region is not produced. Therefore, the glare phenomenon may be prevented from occurring in the boundary of the dark region, while preventing the brightness of light in the regions adjacent to the dark region from decreasing when the dark region is produced.

Automobile

An automobile according to the present invention may include the lamp 10 for an automobile. The descriptions of a configuration, a structure, and an operation principle of the lamp 10 are replaced with the above descriptions.

Here, in the automobile according to the present invention, the lamp 10 may be provided on a left side or a right side of a front portion of the automobile. More preferably, the lamp 10 may be provided on each of both the left side and the right side of the front portion of the automobile. Also, the lamp 10 may be a lamp used in a high beam of the automobile.

According to the present invention, the head lamp having the excellent resolution, luminous intensities, uniformity of brightness of light, or the like may be manufactured while using a smaller number of the light sources than in the related art.

Although the present invention is described by specific embodiments and drawings as described above, the present invention is not limited thereto, and it is obvious that various changes and modifications may be made by a person skilled in the art to which the present invention pertains within the technical idea of the present invention and equivalent scope of the appended claims.

What is claimed is:

1. A lamp for an automobile, the lamp comprising:

first and second modules configured to generate light and emit the light to the outside, the first and second modules being spaced apart from each other, wherein the first module includes a first light source unit having a plurality of light sources configured to generate light and provided in a horizontal direction, and the second module includes a second light source unit having a plurality of light sources configured to generate light and provided in the horizontal direction, wherein the light generated from the plurality of light sources provided in each of the first light source unit and the second light source unit is emitted to the outside to produce a plurality of beam patterns, wherein the plurality of beam patterns produced by all of the plurality of light sources provided in the first light source unit are arranged in the horizontal direction to produce a first beam pattern group, wherein the plurality of beam patterns produced by all of the plurality of light sources provided in the second light source unit are arranged in the horizontal direction to produce a second beam pattern group, wherein at least a portion of the plurality of beam patterns constituting the second beam pattern group is produced in at least a portion of a region between the plurality of beam patterns constituting the first beam pattern group, and wherein a horizontal width of a beam pattern which is produced at one end portion in the horizontal direction among the plurality of beam patterns constituting the first beam pattern group is less than a horizontal width of a beam pattern which is produced at the other end portion in the horizontal direction among the plurality of beam patterns constituting the first beam pattern group.

2. The lamp of claim 1, wherein the first beam pattern group has a plurality of beam patterns having first peaks which are respectively produced by the plurality of light sources constituting the first light source unit and each of which has a maximum value in luminance of the light in a vertical direction, and the second beam pattern group has a plurality of beam patterns having second peaks which are respectively produced by the plurality of light sources constituting the second light source unit and each of which has a maximum value in luminance of the light in a vertical direction, wherein at least the portion of the plurality of the beam patterns of the second beam pattern group having second peaks is provided in at least the portion of the region between the plurality of beam patterns of the first beam pattern group having first peaks.

3. The lamp of claim 1, wherein the first module further comprises:

a first rod unit configured to provide a path through which the light generated by the first light source unit moves; and a first lens through which the light emitted from the first rod unit passes to be emitted to the outside, and the second module further comprises:

a second rod unit configured to provide a path through which the light generated by the second light source unit moves; and a second lens through which the light emitted from the second rod unit passes to be emitted to the outside.

4. The lamp of claim 1, wherein horizontal widths of the plurality of beam patterns constituting the first beam pattern group increase gradually from one end portion of the first beam pattern group in the horizontal direction toward the other end portion of the first beam pattern group in the horizontal direction.

5. The lamp of claim 1, wherein a horizontal width of a beam pattern which is produced at one end portion in the horizontal direction among the plurality of beam patterns constituting the second beam pattern group is less than a horizontal width of a beam pattern which is produced at the other end portion in the horizontal direction among the plurality of beam patterns constituting the second beam pattern group.

6. The lamp of claim 4, wherein horizontal widths of the plurality of beam patterns constituting the second beam pattern group increase gradually from one end portion of the second beam pattern group in the horizontal direction toward the other end portion of the second beam pattern group in the horizontal direction.

7. The lamp of claim 1, wherein at least a portion of the first beam pattern group overlaps at least a portion of the second beam pattern group.

8. The lamp of claim 7, wherein turning on/off of the plurality of light sources constituting the first light source unit and the second light source unit is controlled independently with respect to each other, and when the plurality of light sources that emit light to a portion of an irradiation region produced by the first beam pattern group and the second beam pattern group are turned off, a dark region to which the light does not reach is produced in a portion of the irradiation region.

9. The lamp of claim 8, wherein luminance of the light that is emitted from the plurality of light sources constituting the first light source unit and the second light source unit is controlled independently with respect to each other.

10. An automobile comprising a lamp including:

first and second modules configured to generate light and emit the light to the outside, the first and second modules being spaced apart from each other, wherein the first module includes a first light source unit having a plurality of light sources configured to generate light and provided in a horizontal direction, and the second module includes a second light source unit having a plurality of light sources configured to generate light and provided in the horizontal direction, wherein the light generated from the plurality of light sources provided in each of the first light source unit and the second light source unit is emitted to the outside to produce a plurality of beam patterns, wherein the plurality of beam patterns produced by all of the plurality of light sources provided in the first light source unit are arranged in the horizontal direction to produce a first beam pattern group, wherein the plurality of beam patterns produced by all of the plurality of light sources provided in the second light source unit are arranged in the horizontal direction to produce a second beam pattern group, and wherein at least a portion of the plurality of beam patterns constituting the second beam pattern group is produced in at least a portion of a region between the plurality of beam patterns constituting the first beam pattern group, wherein a horizontal width of a beam pattern which is produced at one end portion in the horizontal direction among the plurality of beam patterns constituting the first beam pattern group is less than a horizontal width of a beam pattern which is produced at the other end portion in the horizontal direction among the plurality of beam patterns constituting the first beam pattern group.

11. The automobile of claim 10, wherein the lamp is provided on a left side or a right side of a front portion of the automobile.

12. A lamp for an automobile, the lamp comprising:

first and second modules configured to generate light and emit the light to the outside, the first and second modules being spaced apart from each other, wherein the first module includes a first light source unit having a plurality of light sources configured to generate light and provided in a horizontal direction, and the second module includes a second light source unit having a plurality of light sources configured to generate light and provided in the horizontal direction, wherein the light generated from the plurality of light sources provided in each of the first light source unit and the second light source unit is emitted to the outside to produce a plurality of beam patterns, wherein the plurality of beam patterns produced by all of the plurality of light sources provided in the first light source unit are arranged in the horizontal direction to produce a first beam pattern group, wherein the plurality of beam patterns produced by all of the plurality of light sources provided in the second light source unit are arranged in the horizontal direction to produce a second beam pattern group, wherein at least a portion of the plurality of beam patterns constituting the second beam pattern group is produced in at least a portion of a region between the plurality of beam patterns constituting the first beam pattern group, and wherein horizontal widths of the plurality of beam patterns constituting the first beam pattern group increase gradually from one end portion of the first beam pattern group in the horizontal direction toward the other end portion of the first beam pattern group in the horizontal direction.

* * * * *